United States Patent [19]

Bialobrzeski et al.

[11] 4,416,477

[45] Nov. 22, 1983

[54] CHILD-PROOF LATCH

[76] Inventors: Walter Bialobrzeski, 68 Summerwood Dr., Wallingford, Conn. 06492; Paul A. Sperry, 376 State St., North Haven, Conn. 06473

[21] Appl. No.: 317,010

[22] Filed: Nov. 2, 1981

[51] Int. Cl.[3] ..... E05C 19/06

[52] U.S. Cl. ..... 292/19; 292/87; 292/DIG. 38

[58] Field of Search ..... 292/19, 87, DIG. 38, 292/31, 228, DIG. 14

[56] References Cited

U.S. PATENT DOCUMENTS

| | | | |
|---|---|---|---|
| 2,333,465 | 11/1943 | Claud-Mantle | 292/DIG. 14 X |
| 2,393,647 | 1/1946 | Marple | 292/DIG. 14 X |
| 3,161,923 | 12/1964 | Crain | 292/228 X |
| 3,397,001 | 8/1968 | Friedman | 292/128 X |
| 4,057,271 | 11/1977 | Colinet | 292/87 |
| 4,223,787 | 9/1980 | Lowry et al. | 292/DIG. 38 X |
| 4,378,948 | 4/1983 | Chrones | 292/19 |

FOREIGN PATENT DOCUMENTS

| | | | |
|---|---|---|---|
| 2655031 | 6/1978 | Fed. Rep. of Germany | 292/87 |
| 2367176 | 6/1978 | France | 292/DIG. 38 X |

*Primary Examiner*—Thomas J. Holko
*Assistant Examiner*—R. Illich
*Attorney, Agent, or Firm*—St. Onge, Steward, Johnston & Reens

[57] ABSTRACT

A child-proof latch for preventing access by young children to drawers, cabinets and the like.

6 Claims, 9 Drawing Figures

CHILD-PROOF LATCH

FIELD OF THE INVENTION

The present invention relates to latches for drawers, cabinets and the like, and more particularly, the present invention relates to "child-proof" latches that cannot be actuated by young children but can easily be actuated by adults.

It is often desirable to prevent young children from gaining access to drawers, cabinets or the like that may contain potentially harmful or dangerous items such as household cleaners, medicines, glue, paint, tools and a great variety of other potentially harmful items. It may also be desirable to prevent access by young children to drawers and cabinets for the purpose of preventing a child from removing and disorganizing items contained therein.

One alternative for preventing access by children to cabinets or drawers is to use conventional locks that are opened by a key or combination. The use of locks is disadvantageous because the adult needs a key or combination for each drawer and thus, the adult would be greatly inconvienced.

It has also been known to equip drawers and cabinets with "child-proof" latches that are difficult or impossible for young children to operate but may be easily operated by an adult. Examples of such previously known latches are described in U.S. Pat. No. 4,139,249 to Hillman; U.S. Pat. No. 3,397,001 to Friedman and U.S. Pat. No. 3,889,992 to Shelton. The latches disclosed in these patents include a base that is installed on the inside surface of a cabinet closure panel. By "cabinet closure panel" it is meant a panel of a drawer or a cabinet door that moves with respect to a frame. The child-proof latches disclosed in the foregoing patents enable a person to open the closure panel to a limited extent only. Thereafter, it is necessary for the person to reach into the drawer or cabinet and release the latch to enable the closure panel to be opened further.

The Friedman Patent discloses a latch comprising a base having a resilient restraining arm protruding outwardly therefrom. The restraining arm includes a lug at the end thereof for engaging a similar lug attached to the frame of the drawer. Although the latch disclosed by Friedman would be helpful in preventing young children from opening the drawer, such latch is disadvantageous because it is relatively simple to actuate in that it requires only that the restraining arm be pushed downwardly by an adult or young child seeking to actuate the latch. Thus, the latch disclosed in Friedman is suitable for preventing only a very young child from opening the drawer and, may be inadvertently opened even by a very young child who simply reaches into the drawer.

The Hillman Patent discloses a latch that is quite similar to the latch disclosed in the Friedman Patent with the exception that the force which biases the restraining arm upwardly is provided by a helical spring rather than being provided by the resilient material of the restraining arm itself as disclosed in the Friedman Patent.

The prior art child-proof latches disclosed in the Friedman and Hillman patents have the common disadvantage that the latch may be opened by simply pushing downwardly on the upper surface of the restraining arm to disengage the latch and to enable the drawer to be opened further. The upper surface of the restraining arm is located very near the opening between the closure panel and the frame and, thus, in clear, unobstructed view of the child who may be able to understand how to actuate the latch. Also, since the upper surface of the restraining arm is located in close proximity to such opening, the child may easily actuate the latch. Thus, it is believed that the prior art latches can be conceptually understood and actuated by young children.

A further disadvantage of prior art child-proof latches is that they tend to allow the closure panel to be opened a substantial amount prior to engagement of the frame by the lug on the restraining arm. With use of prior art child-proof latches, the closure panel must be opened by a substantial amount to enable the adult operating the latch to place his finger on the upper surface of the restaining arm and have sufficient leverage to push the restraining arm downwardly. For example, in the child-proof latch disclosed in the Hillman patent, the upper surface of the restraining arm includes a plate for finger engagement. The Friedman patent discloses a latch wherein the adult presses down on the top of the restraining arm to flex it downwardly. Thus, in prior art child-proof latches, the closure panel can be opened relatively widely with respect to the frame and the young child may gain access to the contents in the front portion of the drawer or cabinet even though he cannot actuate the latch.

It is an object of the present invention to provide a latch that is conceptually difficult for a young child to understand how to actuate. It is also an object of the invention to provide a latch that is physically difficult to actuate so that even if the young child conceptually understands how to operate the latch, he cannot physically actuate it.

SUMMARY OF THE INVENTION

In accordance with the present invention a child-proof latch is provided that is conceptually difficult for a young child to understand how to operate, and, even if the young child conceptually understands how the latch operates, the latch of the present invention is particularly difficult for the child to physically actuate. A child-proof latch in accordance with the present invention comprises a supporting base for mounting on the interior surface of a closure panel such as a drawer panel or a cabinet door that is moveable with respect to a frame. The supporting base may be mounted by screws or other attachment means to the interior surface of the closure panel. A pair of elongate restraining arms project outwardly with respect to the base. The restraining arms extend in a generally parallel relation to each other and are separated along their length by a space. Each restraining arm includes an end portion having a mechanism for abutting the frame of the drawer or cabinet. In a preferred form of the invention the abutting mechanism comprises a lug extending upwardly from the end portion of the restraining arm. The lug includes a stop surface for engaging the frame to limit opening movement of the panel with respect to the frame.

Each restraining arm is biased toward the frame to provide for engagement of the frame by the lug on the arm to limit opening movement of the panel with respect to the frame to a predetermined distance. Each restraining arm is movable independently of the other restraining arm against the bias away from the frame to disengage the abutting mechanism to permit further opening of the panel only upon simultaneous movement of both restaining arms. Thus, a young child seeking to actuate the latch must conceptually understand that both restraining arms must be simultaneously moved downwardly for the latch to open.

In a preferred form of the invention, the latch is formed in a single piece from resilient polymeric material such as, for example, nylon. The arms are formed so that when they are in an unflexed position, they engage the frame. The resilient material provides the bias for the arms, which can be flexed downwardly against such bias to disengage the abutting means. In accordance with one aspect of the invention a rigid wall projects outwardly from the latch base in the space between the restraining arms. The wall has a length sufficient to span the predetermined distance between the open panel and the frame. The wall includes an upper surface located above both restraining arms and, thus, the wall prevents single finger simultaneous movement of both restraining arms. For example, if a young child opens the closure panel, reaches into the drawer and presses on the latch with a single finger, the child may possibly actuate one of the restraining arms by pushing downwardly on it but the other arm would remain engaged. The wall prevents the child from inadvertently pushing both of the restraining arms downwardly with a single finger because a child attempting to do so would contact the rigid wall and would be unable to push simultaneously both restraining arms.

In accordance with another aspect of the present invention, each restraining arm includes an actuating mechanism located beneath it and operable by a force directed toward the latch base. More specifically, the actuating mechanism comprises a tab attached to the base portion of each restraining arm, the tab extending beneath and laterally with respect to each restraining arm. Thus, the tab for one arm extends laterally from one side of its respective arm while the tab of the other arm extends laterally from an opposite side of its respective arm. Each tab includes an outer surface for finger engagement. Thus, the adult attempting to operate the latch places his forefinger on one tab and his middle finger on the other tab while his thumb is placed on the exterior surface of the drawer. The adult simultaneously moves his forefinger and his middle finger toward his thumb to move both tabs simultaneously toward the latch base to pivot the restraining member away from the frame and disengage the abutting mechanism. Once the abutting mechanism has been disengaged the closure panel can be open further. Use of tabs that are operable by force directed toward the latch base has several advantages.

Firstly, in comparison to prior art child-proof latches, the restraining arm of the present invention may be shortened to provide for opening of the closure panel only a relatively small amount while still permitting an adult finger to be inserted between the closure panel and the frame. Thus, since the panel is open only a small amount with respect to the frame, the young child seeking to open the drawer or cabinet will only be able to open it a limited amount thereby substantially preventing his access to contents in the front portion of the drawer or cabinet. Secondly, because the closure panel is open only a small amount, it is much more difficult for the young child to view and conceptually understand how to operate the latch. Further, since the tabs are located beneath the restraining arms, the adult operating the latch must reach in with his fingers, which are bridged over the rigid wall, to a relatively substantial depth to engage the tabs with his finger tips. It is very difficult or impossible for a young child to reach into the drawer or cabinet to such a depth because his fingers are typically not sufficiently long enough. Furthermore, a latch of the type using tabs movable toward the latch base requires that the adult actuating the latch move his forefinger and middle finger with respect to his thumb with substantial force. Such a task, while being quite simple for an adult, is quite difficult for a young child because he does not typically have the strength and coordination to perform the task.

To summarize the advantages of the latch in accordance with the present invention, the latch is conceptually difficult for a young child to understand how to operate because it requires simultaneous operation of two independently actuated restraining arms. When tabs located beneath and laterally with respect to the restraining arm are used, the child must reach in to the cabinet or drawer through a narrow opening and push both tabs simultaneously towards the base of the latch. In addition to the conceptual difficulties a young child would have actuating the latch, the young child would have the physical difficulty of having sufficient finger length to reach the tabs, and, even assuming the child reaches the tab it would be difficult for him to have sufficient strength to move both tabs simultaneously.

Further advantages of a latch in accordance with the present invention will be described in detail with respect to the following drawings.

DETAILED DESCRIPTION OF THE INVENTION

Figure 1:
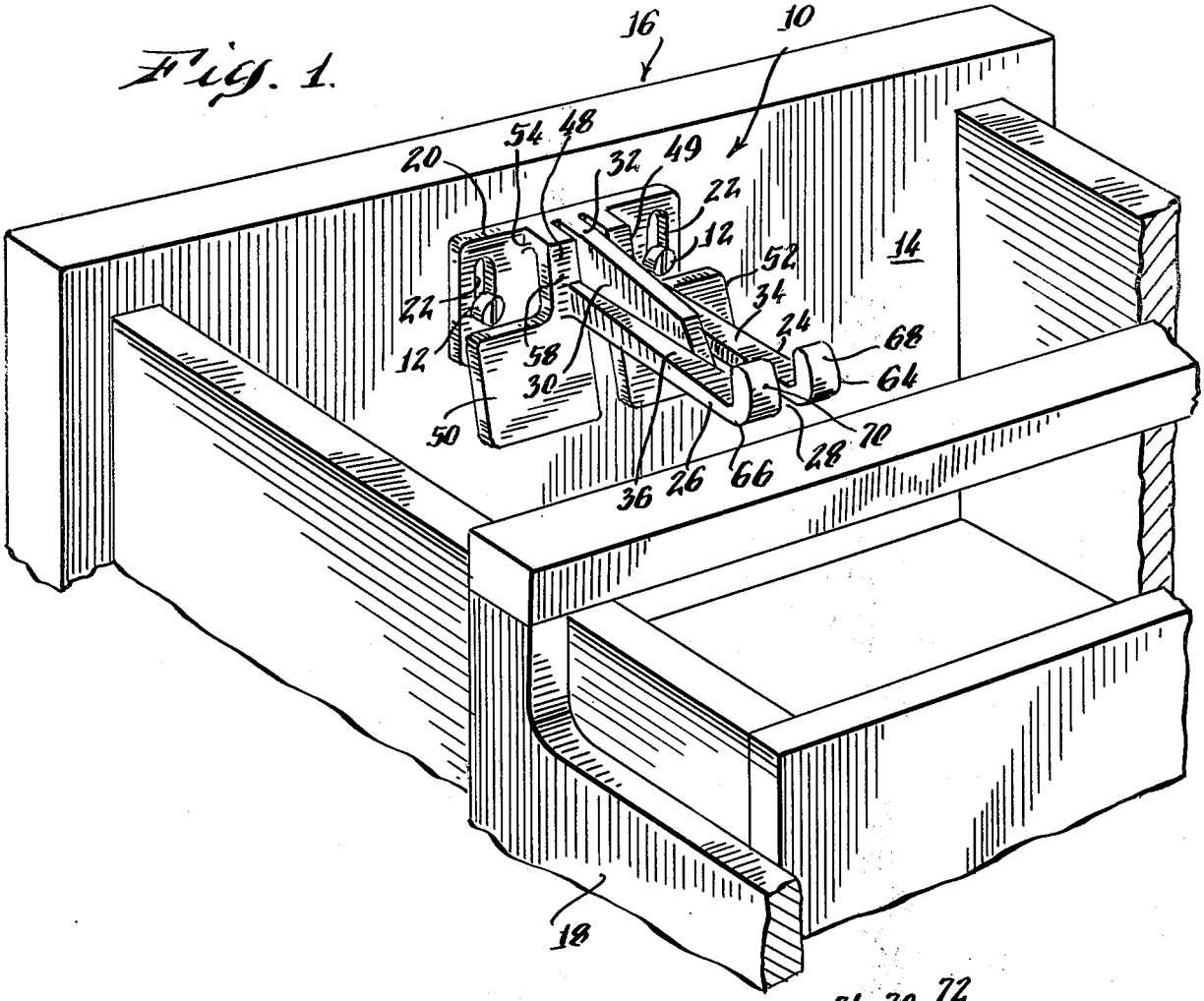
FIG. 1 is a perspective view of a latch in accordance with the present invention mounted on the closure panel of an open drawer.

Referring in particular to FIG. 1, the latch 10 is attached by screw fasteners 12 to the interior surface 14 of a conventional drawer 16 that is movable with respect to a drawer frame 18. It should be understood, however, that the latch of the present invention may be used in other environs wherein a closure panel is movable with respect to a frame, and more particularly, the child-proof latch of the present invention may be used in a cabinet that has doors that swing open with respect to a frame or another door.

Figure 2:
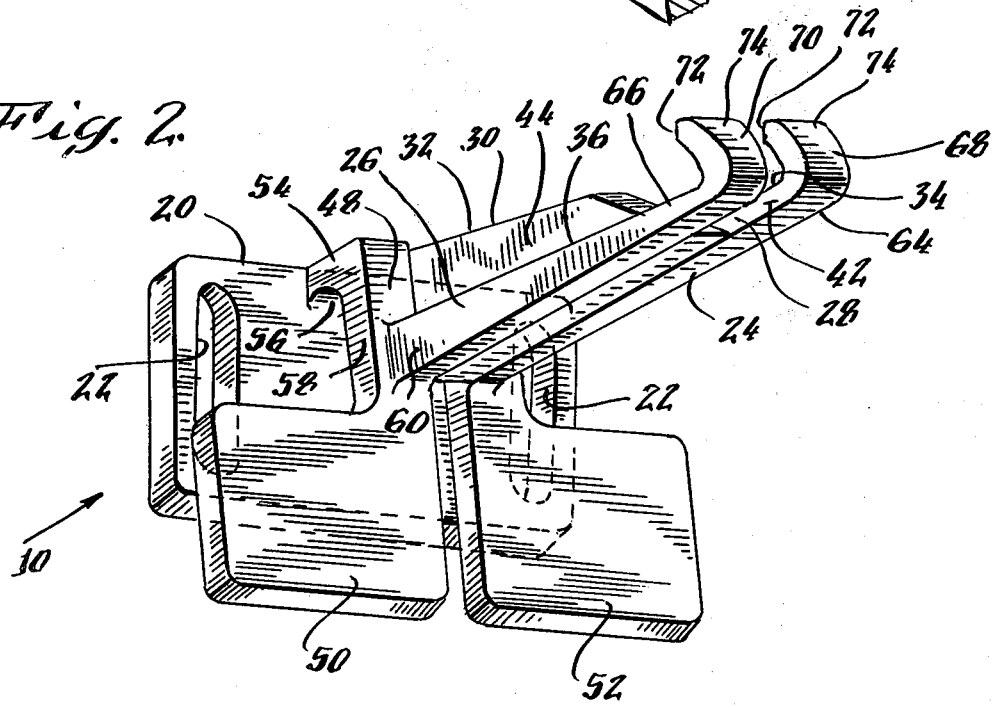
FIG. 2 is a perspective view of the latch shown in FIG. 1 taken from beneath the latch.

Referring in particular to FIGS. 1 and 2 as well as the other figures, a child-proof latch in accordance with the present invention includes a support base 20 for mounting on the interior surface 14 of closure panel 16. The base 20 preferably has a flat rectangular shape and includes two apertures 22 for receiving screw fasteners 12. The apertures 22 are elongate to enable the vertical position of the latch to be adjusted once the screw fasteners are set but not fully tightened into their respective holes. For example, the latch may be loosely attached by the screws 12 so that it is free to move upwardly and downwardly. The vertical position of the latch is set so that it is in a proper position for operation.

Figure 3:
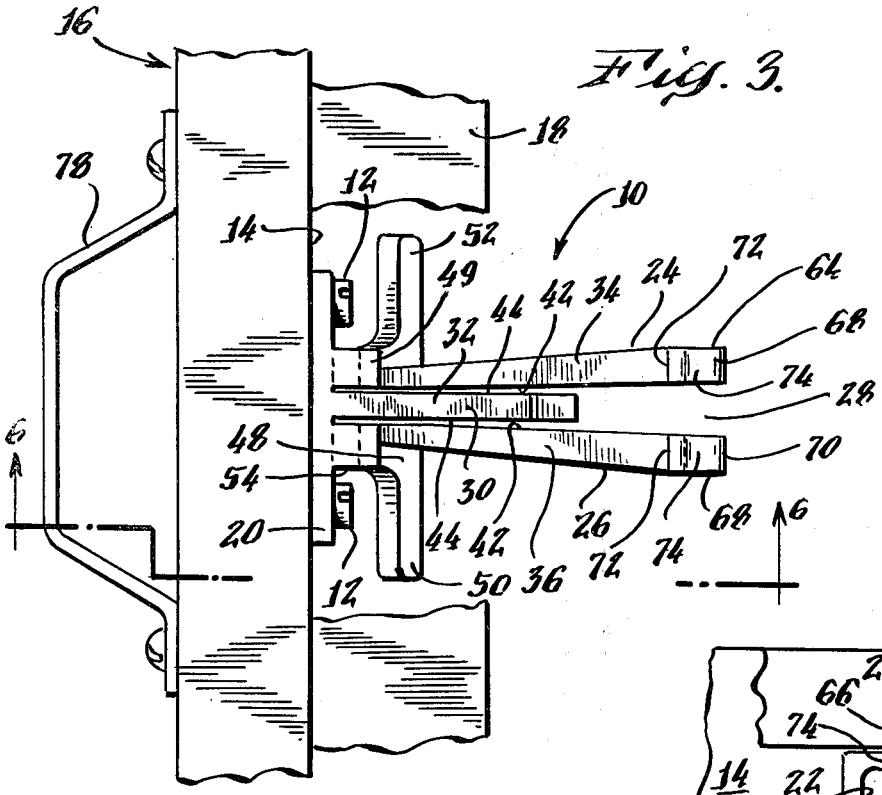
FIG. 3 is a top plan view of the latch shown in FIG. 1.
Figure 4:
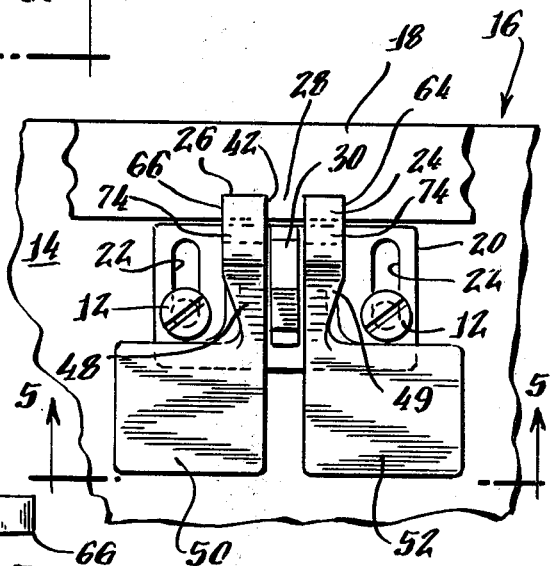
FIG. 4 is a front plan view of the latch shown in FIG. 3.
Figure 5:
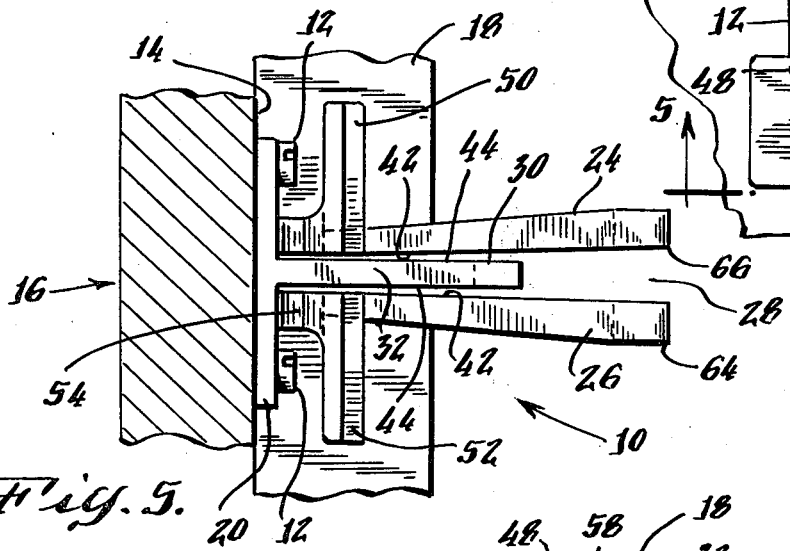
FIG. 5 is a bottom plan view of the latch shown in FIGS. 3 and 4.
Figure 7A:
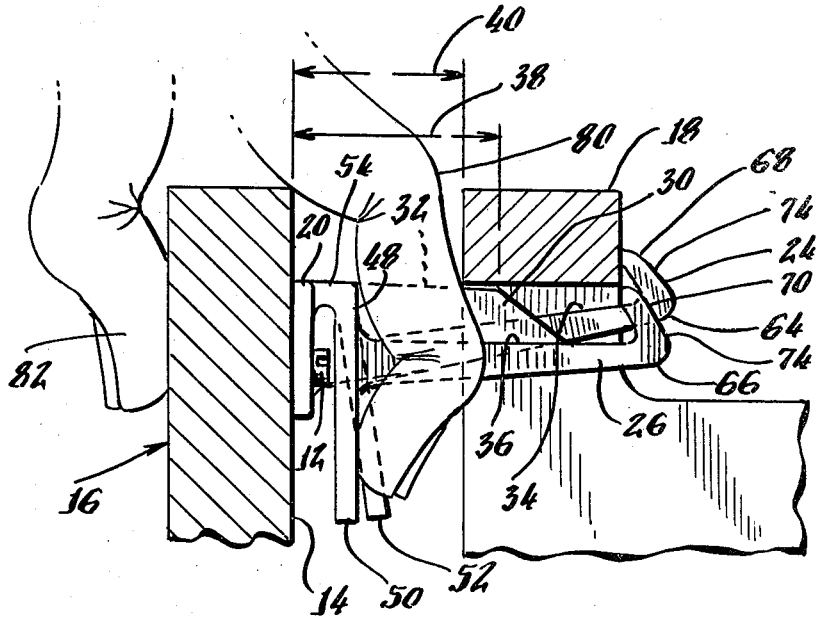
FIG. 7A is a side view similar to that of FIG. 6 except that the drawer has been partially opened and one of the restraining arms has been flexed downwardly by operation of one of the tabs by the forefinger and thumb of an adult operating the latch.

The latch 10 includes a pair of elongate restraining arms 24 and 26 that project outwardly with respect to the base 20. The arms 24 and 26 extend in generally parallel relation to each other and are separated along their length by a space 28 (see FIGS. 1, 3 and 5). A wall 30 projects outwardly from the base 20 and is preferably rigid. The wall 30 includes an upper surface 32 that is located above the upper surfaces 34 and 36 of restraining arms 24 and 26 (see FIG. 1). As shown particularly well in FIG. 7A, wall 30 has a length 38 sufficient to span the distance 40 between the closure panel 16 and the frame 18 when the closure panel 16 is in the limited open position shown in FIG. 7A. Wall 30 functions to prevent single finger simultaneous movement of both restraining arms 24 and 26 by imposition of a downward force on the upper surfaces 34 and 36 of the arms. Thus, a young child reaching into the drawer cannot inadvertently open the latch by moving the restraining arms downwardly. As shown particularly well in the FIGS. 3, 4 and 5, the interior surface 42 of arms 24 and 26 are preferably located immediately adjacent the side surfaces 44 of wall 32. The arms 24 and 26 taper gradually as they approach base 20 to minimize the amount of surface area that may be contacted by the finger of a young child seeking to open the latch. As shown in FIG. 7A, the upper surface 32 of the wall is preferably located substantially above the upper surfaces 36 and 34 of the arms. The combination of the relatively small upper surface area of the arms, the fact that the arms are positioned immediately adjacent to wall 30 and the fact that the arms are located a substantial distance below the upper surface 32 of wall 30 makes it extremely difficult for a young child to actuate the arms by pushing his fingers downwardly on the upper surfaces thereof. It should be noted, however, that there is a space 46 provided between each arm and wall 30 to avoid any substantial friction during actuation of the arms as will be described below.

Figure 6:
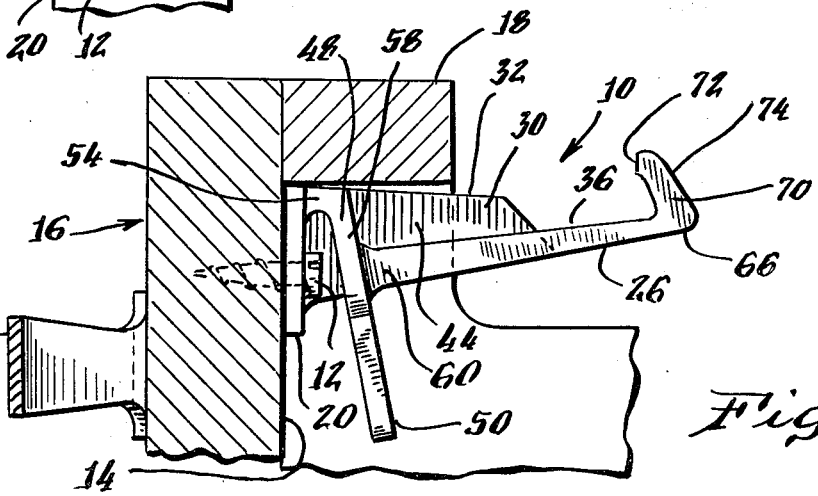
FIG. 6 is a side plan view of the latch shown in FIGS. 3 through 5 with the drawer sectioned away along the plane 6—6 of FIG. 3.

Referring in particular to FIGS. 1, 2 and 6, the latch 10 further includes for each restraining arm, a bracket 48 for supporting its arm 26 and an actuation tab 50. Restraining arm 24 includes a similar bracket 49 for supporting it and tab 52. Only bracket 48 will be described in detail. Bracket 48 includes a spacer 54 projecting outwardly from the base 20 to provide a space 56 between the tab 50 and base 20 (see FIG. 6). Bracket 48 further includes a strut 58 depending downwardly from the spacer for supporting the tab 50 and the restraing arm 26. The restraining arm 26 includes a base portion 60 that is mounted on and projects outwardly from the strut 58. Tabs 50 and 51 are preferably rectangular as shown but also may have other shapes that allow finger-tip actuation.

In accordance with a preferred aspect of the invention, the bracket 48 comprises a resilient polymeric material such as, for example, nylon to provide for flexing of the strut towards the base upon imposition of finger force on its respective tab 50. It should be understood however, that various types of thermoplastics and reinforced plastics may be used. In the most preferred form of the invention, the entire latch is formed in a single piece from resilient polymeric material.

Each restraining arm 24 and 26 includes on its respective end portion 64 and 66 a mechanism 68 and 70 for abutting the frame 18. The abutting mechanism 68 and 70 preferably is a lug that protrudes upwardly from the top surfaces 34 and 36 of the arms. Each lug 70 includes a stop surface 72 that contacts frame 18 to limit opening movement of the panel to a predetermined distance 40 (see FIG. 7A). Each lug also includes an inclined cam surface 74 for engaging the frame 18 upon closing movement of the closure panel 16 to force its respective restraining arm downwardly as shown in FIG. 7C.

The operation of the child-proof latch will now be described with respect to FIGS. 6, 7A, 7B and 7C. Referring to FIG. 6, the figure shows the drawer in the closed position. A person seeking to open the drawer grasps handle 78 and moves the drawer from the position shown in FIG. 6 to the position shown in FIG. 7A. When the closure panel 16 of the drawer has been moved outwardly with respect to the frame 18 a predetermined distance 40, the stop surfaces 72 on the lugs 68 and 70 contact the drawer frame 18 and prevent further opening movement of the drawer. As shown in FIG. 7A, an adult forefinger 80 has been inserted in the drawer so that the finger tip touches tab 50. The adult's thumb 82 is positioned in contact with the outer surface of closure panel 16. As shown in FIG. 7A, the tab 50 has been moved by the adult index finger toward the base to disengage lug however, lug 68 is still engaged thus preventing further opening movement of the drawer. As can be appreciated from the view shown in FIG. 7A, the adult forefinger must reach into the drawer to a relatively deep depth to contact finger tab 50. Typically, a young child's fingers do not have sufficient length to reach the tab 50.

Figure 7B:
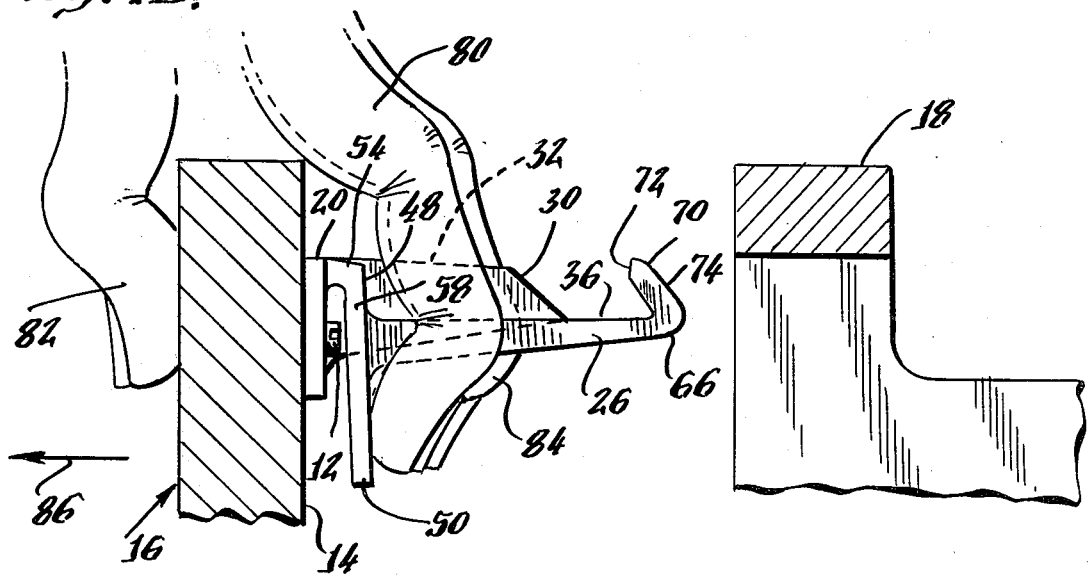
FIG. 7B is a view similar to that shown in FIG. 7A except that both the forefinger and the middle finger of an adult operating the latch have pushed their respective tabs to disengage both restraining arms to permit unrestricted opening of the drawer.

Referring to FIG. 7B, the adult has positioned his middle finger in contact with operating tab 52 and has moved the lug 68 downwardly to disengage it from the frame 18. The drawer has been pulled outwardly in the direction of arrow 86 to enable the adult to have full access to the contents of the drawer.

Figure 7C:
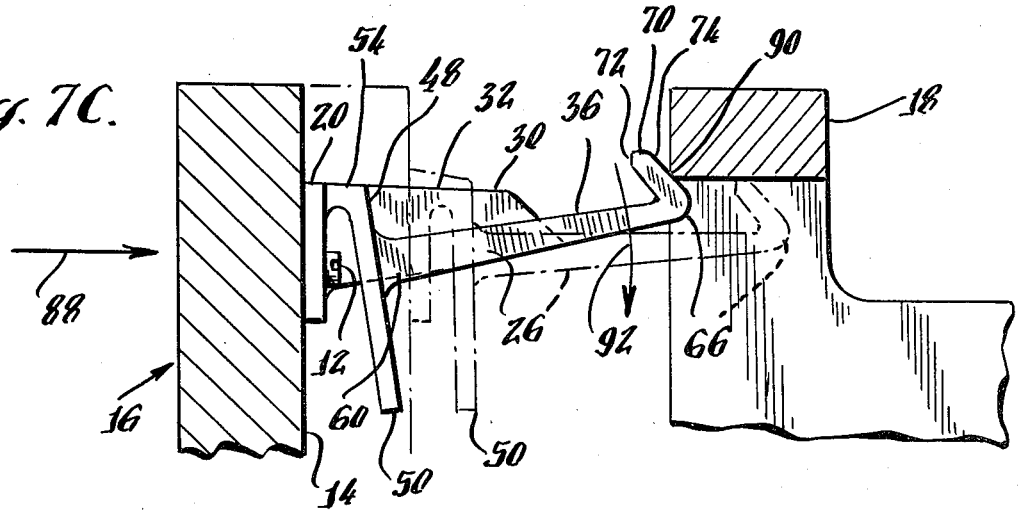
FIG. 7C is a view similar to those shown in FIGS. 7A and 7B wherein the drawer is being moved toward the closed position and the restraining arms have been cammed downwardly by the frame to enable the drawer to be fully closed.

As shown in FIG. 7C, when the adult desired to shut the drawer, he simply pushes the drawer in the direction shown by arrow 88 to move the closure panel 16 inwardly toward frame 18. The inclined cam surface 74 on each of the lugs 68 and 70 contacts the bottom corner 90 of the frame 18 and is cammed downwardly as shown by arrow 92. Thereafter, the drawer 16 may be slid inwardly to the position shown in phantom in FIG. 7C, and thereafter, the drawer can be slid even further to the closed position shown in FIG. 6.

In summary, the latch of the present invention is conceptually difficult for young children to understand how to operate since it involves the simultaneous actuation of tabs 50 and 52. Even if the young child conceptually understands how to operate the latch, the latch of the present invention is particularly difficult for the child to physically actuate because it requires a great deal of manual dexterity and physical strength, which a yound child typically does not have.

It should be understood that although specific embodiments of the invention have been described herein in detail, such description is for purposes of illustration only and modifications may be made thereto by those skilled in the art within the scope of the invention.

What is claimed is:

1. A child-proof latch for attachment to a closure panel of a drawer, cabinet or the like, the closure panel being moveable with respect to a frame or the like, the latch comprising:

a support base for mounting on said closure panel;

a pair of elongate restraining arms projecting outwardly with respect to said base in generally parallel relation to each other and being separated along their length by a space, each said restraining arm having an end portion including means for abutting said frame, said restraining arms being biased toward said frame to provide for engagement of said frame by both said abutting said panel with respect to said frame to a predetermined distance, each said restraining arm being movable independently of the other restraining arm against said bias away from said frame to disengage said abutting means to permit further opening of said panel only upon simultaneous movement of both restraining arms; and a wall projecting from said base in said space between said restraining arms, said wall having a length sufficient to span the said predetermined distance between said panel and said frame, said wall including an upper surface located above said restraining arms, said wall for preventing single finger simultaneous movement of both said restraining arms by imposition of a downward force on said restraining arms.

2. A child-proof latch according to claim 1 and further including for each said restraining arm, actuating means located beneath said restraining arm and operable by a force directed towards said base for moving said restraining arm downwardly against said bias to disengage said abutting means.

3. A latch according to claim 1 wherein each said restraining arm includes a base portion and wherein for each said arm said actuating means comprises a tab attached to said base portion, said tab extending beneath and laterally from said restraining arm, said tab including an outer surface for finger engagement and being moveable by said force to pivot said restraining member away from said frame to thereby disengage said abutting means.

4. A latch according to claim 3 and further including for each said arm a bracket for supporting said restraining arm and said tab, said bracket including a spacer projecting outwardly from said base to provide a space between said tab and said base and including a strut depending downwardly from said spacer for supporting said tab and said restraining arm, said base portion of said restraining arm being mounted on and projecting outwardly from said strut.

5. A latch according to claim 4 wherein each said bracket comprises a resilient material to provide for flexing of said strut toward said base upon imposition of finger force on said tab to disengage said abutting means and for restoring said strut to its original position upon release of said finger force.

6. A latch according to claim 5 wherein said base, said restraining arms, said brackets and said tabs comprise resilient polymeric material formed in a single piece.

* * * * *